United States Patent [19]

Milo

[11] Patent Number: 4,481,797

[45] Date of Patent: Nov. 13, 1984

[54] TANK FILL CAP LOCKING SYSTEM

[76] Inventor: August Milo, 478 Schiller St., Elizabeth, N.J. 07206

[21] Appl. No.: 344,988

[22] Filed: Feb. 2, 1982

[51] Int. Cl.[3] ..... B65D 55/14; B65D 53/00

[52] U.S. Cl. ..... 70/167; 70/164; 70/DIG. 58; 220/214; 220/318

[58] Field of Search ..... 70/34, 163-169, 70/DIG. 58; 220/210, 214, 318, 322

[56] References Cited

U.S. PATENT DOCUMENTS

| | | | |
|---|---|---|---|
| 1,599,685 | 9/1926 | Spaeth | 70/164 X |
| 1,774,439 | 8/1930 | Holtson | 70/168 X |
| 2,138,871 | 12/1938 | Malluck | 70/165 |
| 2,315,644 | 4/1943 | Nahm | 70/163 X |
| 3,835,674 | 9/1974 | Hoyt | 70/34 |
| 3,950,971 | 4/1976 | Karls | 70/164 |
| 4,014,367 | 3/1977 | Milo | 220/318 X |
| 4,062,596 | 12/1977 | Kull | 220/322 X |
| 4,331,012 | 5/1982 | Swisher | 70/164 |

FOREIGN PATENT DOCUMENTS

| | | | |
|---|---|---|---|
| 1290330 | 9/1972 | United Kingdom | 70/163 |

OTHER PUBLICATIONS

Universal Valve Company Catalog, "A Complete Line of Service Station Valves/Fittings, Vapor Recovery Systems", pp. 16 and 17.

*Primary Examiner*—Gary L. Smith
*Assistant Examiner*—R. Illich
*Attorney, Agent, or Firm*—Karl L. Spivak

[57] ABSTRACT

The tank fill locking system includes a special coupling adapted to fit upon the top of the tank fill pipe within the manhole. A flat top cap is removably attached to the coupling and includes aligned lock receiving openings when the handle is moved to the closed position. An upper, first, hardened steel plate overfits the fill cap within the manhole and is provided with suitable brackets to engage both the handle and the locks. Preferably, straight shackle locks are employed. A second or inner locking plate secures within the coupling below the flat cap and is also provided with a lock to lock the second plate within the coupling and thereby prevent access to the tank through the fill pipe.

14 Claims, 9 Drawing Figures

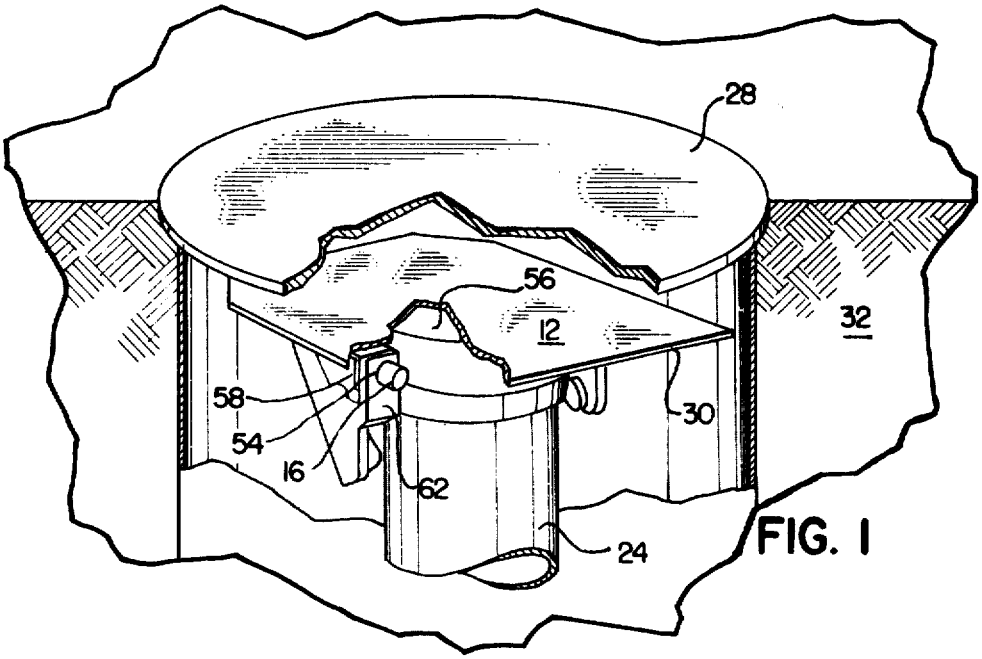
FIG. 1
FIG. 2
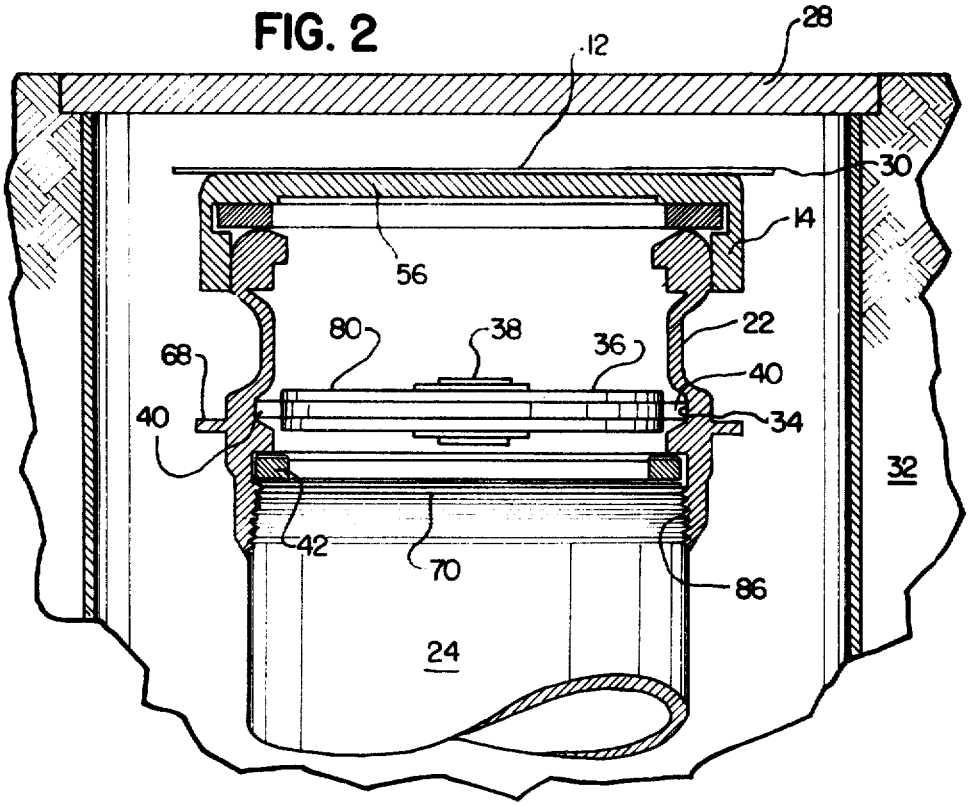

TANK FILL CAP LOCKING SYSTEM

BACKGROUND OF THE INVENTION

The present invention relates generally to the field of locking devices, and more particularly is directed to a locking system designed specifically to protect the fill pipes of underground flammable liquid storage tanks.

It is the common practice to store flammable liquids in underground storage tanks of either steel or fiberglass construction to provide for increased safety by minimizing the possibility of fire or explosion. In the usual automobile gasoline service station provided for the retail sale of gasoline, it is the present practice to store such flammables in relatively large size underground storage tanks, for example tanks of generally two thousand gallons to ten thousand gallons capacity or even more. Most gasoline service stations dispense three or more grades or products and such service stations usually include two or more separate islands or dispensing locations. Accordingly, multiple banks of such underground flammable liquid storage tanks are commonly in use throughout this and other countries.

Fill pipes lead from ground level to the underground storage tanks to facilitate easy filling of the tanks in well known manner. The fill pipes generally terminate at ground level in a known type of manhole or fill box construction and are equipped with conventional removable caps. Unless adequately protected by locking devices, these fill pipes could be easily accessible at ground level to unauthorized personnel. Considering then the present price of gasoline and the number of gallons of such product which are usually stored at a given service station location, it will be appreciated that the underground flammable liquid storage capacity represents a considerable investment to the service station owner or operator. Because of the ever increasing value of the underground stored flammable product, and the generally exposed and accessible location of most service stations, protective steps have been and must be taken to prevent and discourage the theft of gasoline during evening hours or during other periods when most service stations are closed and unattended.

In efforts to protect the service station owners and operators from major losses as a result of flammable liquid theft, prior workers in the art have designed and have utilized locking type caps for installation over the upper ends of the flammable liquid tank fill pipes to prevent tampering with the apparatus and to discourage unauthorized removal or theft of the stored liquid contents. While the presently available locking type fill caps have provided an increased degree of protection, it has been found that the devices that are currently available are prone to tampering and destruction by determined thieves. Because of the fact that most service stations close at night and that numerous service stations are located in relatively quiet areas where pedestrians would not ordinarily be expected to pass during late hours, would-be thieves usually have adequate time in which to pick, pry, or otherwise destroy the locks at the storage tank fill pipes to thereby gain entrance to the underground stored materials.

While of course, almost any type of lock can be broken if the thief possesses sufficient skill, the necessary tools, adequate determination and suitable time within which to do the job, the need remains to provide an extremely sturdy, simply designed and relatively inexpensive tank fill cap lockingif the thief possesses sufficient skill, the necessary tools, adequate determination and suitable time within which to do the job, the need remains to provide an extremely sturdy, simply designed and relatively inexpensive tank fill cap locking system which can offer the maximum deterrence to the efforts of a would-be gasoline thief.

SUMMARY OF THE INVENTION

The present invention relates generally to the field of locks for the fill pipes to underground flammable liquid storage tanks, and more particularly, is directed to an improved fill cap locking system which is designed to offer maximum protection against forceable entry.

The present invention includes a first hardened steel, upper locking plate of size to fit within the usual manhole and which includes attaching brackets suitable for locking upon the handle of a flat top cap. In a slightly modified embodiment, the system can also be employed with a step-on or toggle type fill pipe cap construction.

In the preferred embodiment, straight shackle type locks secure the handle of a flat type cap in a protected manner beneath the hardened steel plate whereby the locks are not easily accessible to bolt cutters, drills or other types of lock destroying devices. A modified adaptor is applied over the end of the fill pipe and is secured thereto by employing suitable cone point screws or other fasteners. The adaptor is provided with an internal, peripheral groove to receive and lock therein a second locking plate. The second locking plate includes a key cylinder and a plurality of locking lugs which are actuated by the key cylinder to engage within the adaptor internal groove. Accordingly then, even if the outer, hardened steel locking plate would be somehow removed and the flat top cap was also removed, the second locking plate would still be positioned within the entrance to the fill pipe to provide an additional barrier to access to the underground stored liquid.

In the preferred embodiment, the adaptor is equipped interiorly with a gage ring having an internal diameter that is less than the outer diameter of the second locking plate to thereby prevent inadvertant dropping of the locking plate through the fill pipe and into the underground storage tank itself.

It is anticipated that the maximum protection offered by the tank fill cap locking system of the present invention would be utilized by employing all of the protective features of the system. That is, the outer or first hardened steel plate, one or more straight shackle high security locks through the cap handle supports and the interiorly positioned second locking plate. However, any of the major security components of the present invention, by itself, could serve to provide tank protection under given circumstances. As a collective, cooperating unit however, the components of the system would be much more effectively employed.

It is therefore an object of the present invention to provide an improved tank fill cap locking system of the type set forth.

It is another object of the present invention to provide a novel tank fill cap locking system that incorporates an outer, hardened steel, locking plate of suitable size to position within the usual fill cap manhole construction.

It is another object of the present invention to provide a novel fill cap locking system that incorporates an upper, first locking plate, cap handle locking means and an interior, second locking plate to prevent unauthorized removal of the liquid stored within underground flammable liquid storage tanks.

It is another object of the present invention to provide a novel fill cap locking system for underground liquid storage tanks which comprises generally an upper, first locking plate of size to fit within the tank fill manhole, a locking means to prevent unauthorized removal of a flat top cap, an adaptor secured to the top of the tank fill and including an internal groove and a second locking plate including a key cylinder and locking lugs responsive to cylinder operation to secure the second locking plate within the adaptor groove for additional obstruction of the tank fill pipe.

It is another object of the present invention to provide a novel tank fill cap locking system comprising a flat top cap, an upper first locking plate means, lock means to prevent unauthorized removal of the flat top cap, the lock means securing the upper locking plate means to the flat top cap, adaptor means receiving the flat top cap and including an interior groove, and second locking plate means lockably secured within the internal groove to prevent unauthorized access to the liquid contents of an underground flammable liquid storage tank.

It is another object of the present invention to provide a novel tank fill cap locking system that is simple in design, rugged in construction and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a perspective view of the top of a fill pipe protected by a lock assembly in accordance with the present invention, partially broken away to expose interior construction details.

FIG. 2 is an enlarged, cross sectional through the manhole and lock assembly of FIG. 1.

DESCRIPTION OF THE PREFERRED EMBODIMENT OF THE INVENTION

Figure 3:
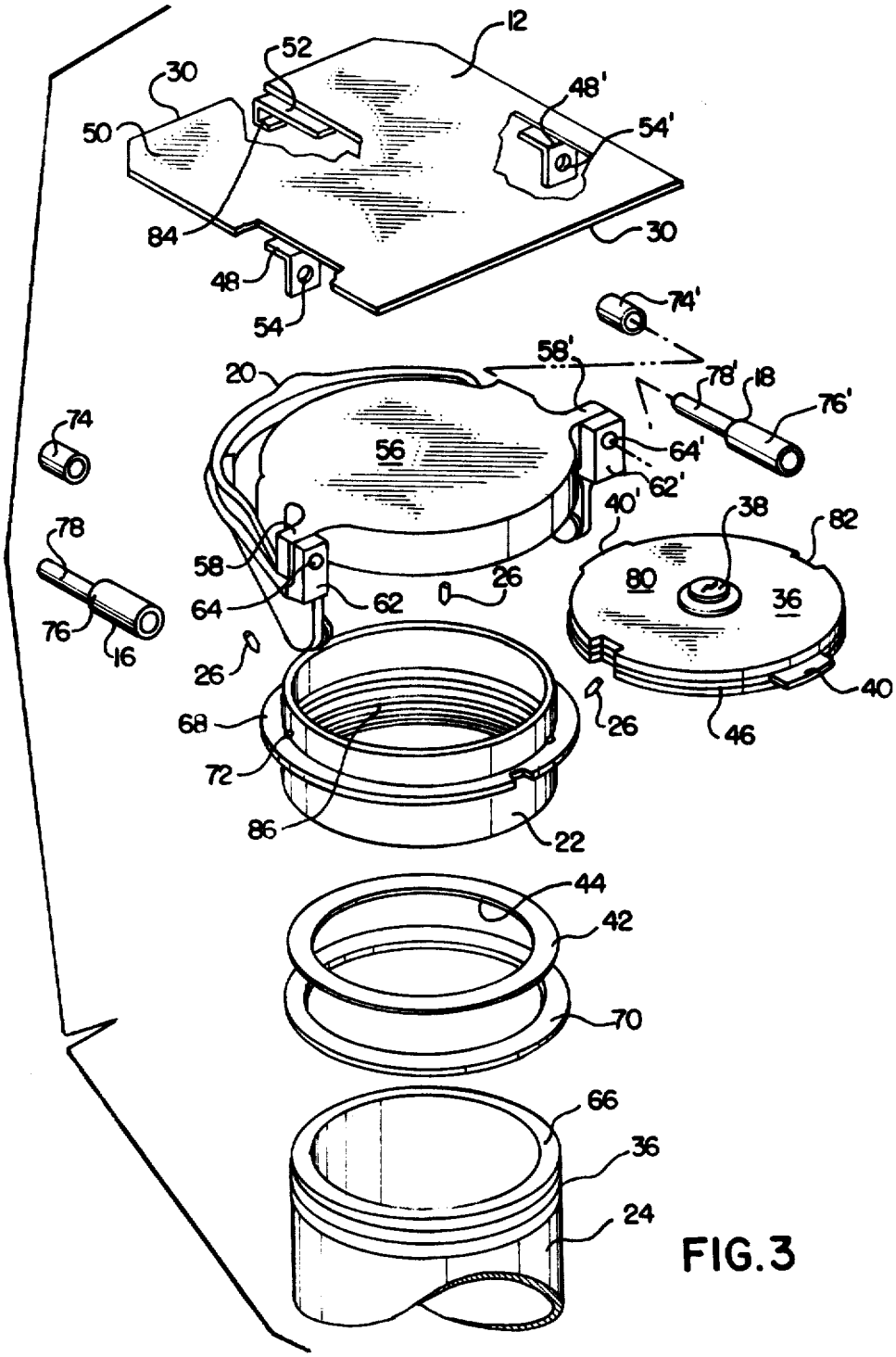
FIG. 3 is an exploded, perspective view of the fill pipe lock assembly.

Although specific terms are used in the following description for the sake of clarity these terms are intended to refer only to the particular structure of the invention selected for illustration in the drawings and are not intended to define or limit the scope of the invention.

Referring now to the drawings, there is illustrated in FIGS. 2 and 3 a tank fill cap locking system generally designated 10 which comprises generally an upper or first, hardened steel, locking plate 12 which is positioned over a flat top or other type of cap 14 in protective association thereover. One or more straight shackle type, high security locks 16, 18 prevent unauthorized raising of the cap handle 20 and also, in the preferred embodiment, prevent unauthorized removal of the upper, first locking plate 12.

An adaptor 22 overfits the top of the underground storage tank fill pipe 24 in threaded engagement in the usual manner and may be secured thereto by employing a plurality of suitable fasteners, for example cone point screws 26. Preferably, the hardened steel, first locking plate 12 is fabricated to a generally square, planar configuration of size large enough to cover the fill cap 14 and the locks 16, 18 to protect the locks from attack from above. As illustrated, the first locking plate 12 should also be small enough to fit within the usual fill cap manhole 28 while at the same time providing adequate access to the lock cylinders between the peripheral edges 30 of the first locking plate 12 and the manhole sidewalls 32.

In the embodiment illustrated, the adaptor 22 is provided with an internal groove 34 which may be machined or otherwise formed interiorly of the adaptor to receive therein in locking engagement the second locking plate 36. The second locking plate is provided with a key cylinder 38 and one or more locking lugs 40, 40' which are actuated by the key cylinder between locking and unlocking positions in known manner. The locking lugs releasably secure the second locking plate 36 in obstructing position in axial alignment over the fill pipe 24 by extending into the adaptor internal groove 34. Preferably, as shown, the adaptor 22 is also equipped with a thin, interiorly positioned gage ring 42 below the internal groove 34. The inner diameter 44 of the thin gage ring 42 is fabricated smaller than the outer diameter 46 of the second locking plate 36 as a safety precaution to prevent inadvertant dropping of the second locking plate 36 down through the adaptor 22 and the fill pipe 24.

Figure 4:
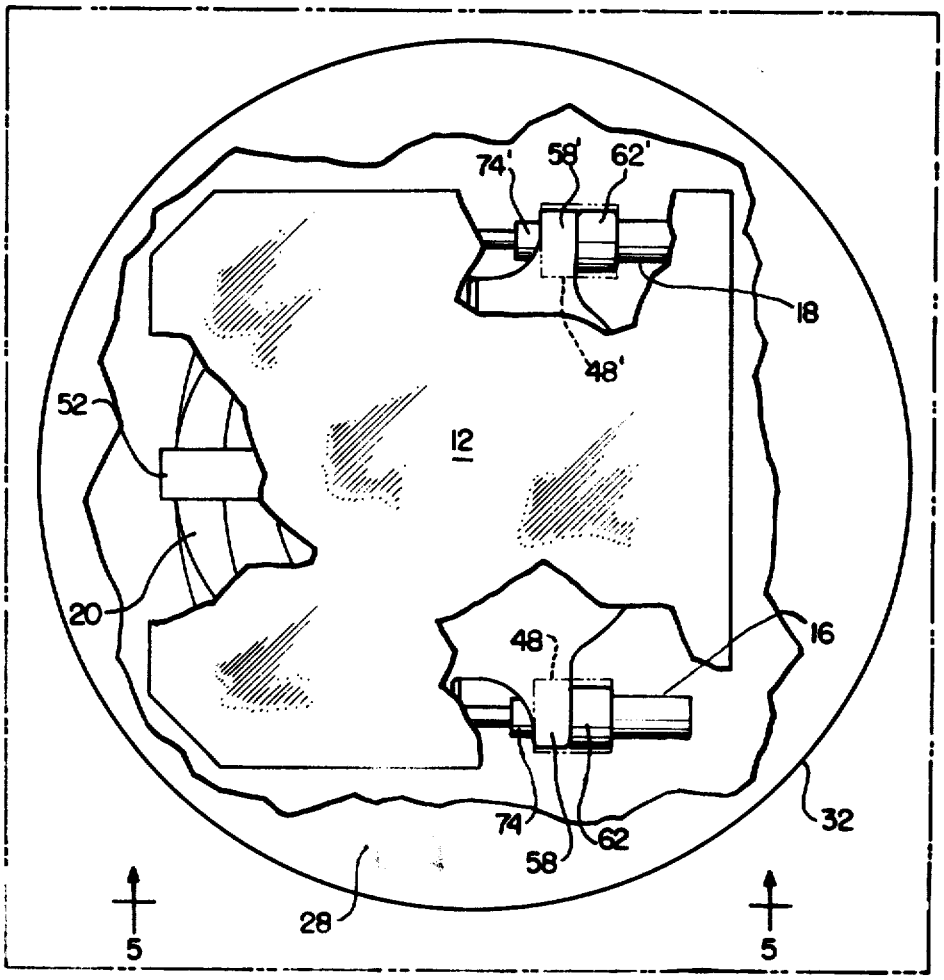
FIG. 4 is a top plan view of the fill pipe lock assembly of the present invention without the interior, second locking plate, and partly broken away to expose interior construction features.
Figure 5:
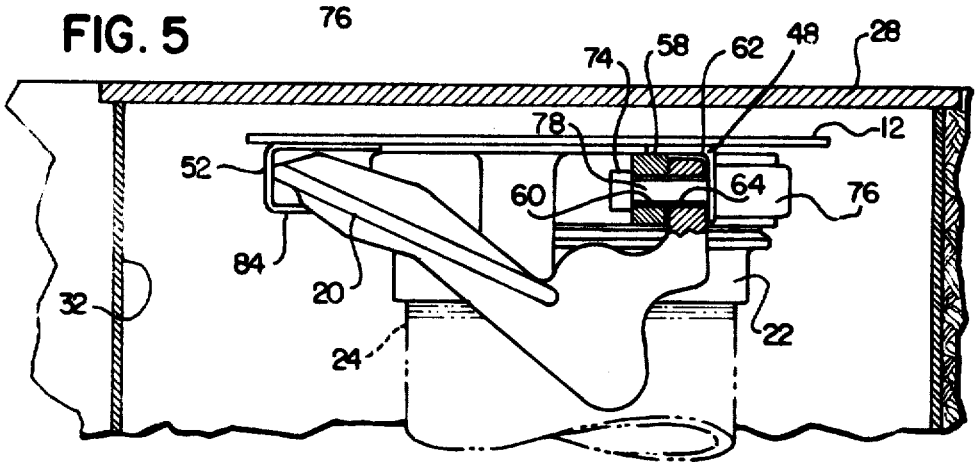
FIG. 5 is a side elevational view of the lock assembly of FIG. 4, looking from line 5—5 and partly broken away to expose interior construction details.

Referring now to FIGS. 3, 4 and 5, the first locking plate 12 is preferably fabricated of hardened steel of suitable thickness to protect the fill cap 14 and locks 16, 18 from impacts, cutters or prying actions and includes a pair of spaced locking brackets 48, 48' and a handle bracket 52, which brackets can be welded or otherwise rigidly secured to the underside of the first locking plate body 50 in the relative positions illustrated. The locking brackets 48, 48' include lock receiving openings 54, 54' for locking purposes as hereinafter more fully set forth. The handle bracket 52 includes a bent lip 84 to engage upon the locked fill cap handle 20 to further discourage theft operations. See FIG. 5.

The tank fill cap 14 is of known design, for example, flat top cap Number 732 as manufactured and sold by Universal Valve Co., Inc., Elizebeth, N.J. The cap is useful in closing the top opening of a conventional underground tank fill pipe 24 in well known manner. The cap 14 comprises generally a closure body 56 and a pivotal handle 20 and is of size and configuration to lock upon a conventional fill pipe adaptor fitting 22. In the usual manner, the closure body 56 is provided with a pair of extending cap locking lugs 58, 58' which include horizontal bores or openings 60, 60' therethrough. The cap handle 20 itself terminates rearwardly in spaced cap locking fingers 62, 62', which fingers are provided with horizontal openings 64, 64'. The closure body openings 60, 60' align with the cap locking finger openings 62, 62' when the handle 20 is urged to is closed position as illustrated to receive therethrough preferably a straight shackle lock 16, 18 (or other type of lock) to thereby secure the handle 20 in the closed and locked position.

Referring now to FIGS. 2 and 3, the adaptor 22 is shown affixed over the top 66 of the tank fill pipe 24 by utilizing the threads 86, and a gasket 70. A plurality of fasteners, such as cone point screws 26, secure the adaptor 22 to the fill pipe 24 so that the assembly 10 cannot be turned, or twisted, or otherwise removed from the top of the fill pipe 24 to thereby circumvent the purpose of the present invention. Preferably, the cone point set screws 26 should be located so that they are protected from unauthorized access or tampering by the locked cap construction 14. Suitable drilled and tapped openings 72 are provided in the flange 68 to receive the set screws 26 in known manner.

As best seen in FIGS. 3 and 4, it will be observed that the locking devices 16, 18 employed are preferably straight shackle type high security locks, each of which comprises a short locking cap 74, 74', a key cylinder 76, 76' and a cylindrical locking body 78, 78'. In the preferred embodiment, the short locking caps 74, 74' are pressed fitted or otherwise securely fastened within the cap locking lug openings 60, 60' to lockably receive therein the respective locking bodies 78, 78' of the lock cylinders 76, 76'. It will be appreciated that conventional padlocks (not illustrated) or other familiar locking devices could optionally be employed in place of the straight shackle locks 16, 18 by positioning such locking devices through the aligned cap and handle openings 60, 64 and 60', 64' respectively. One suitable straight shackle type high security lock which could be employed with the present invention is the straight shackle lock manufactured by E. J. Brooks under the mark "Meter Lock" and which incorporates an "Abloy" disk cylinder. As illustrated, the key cylinder portions 76, 76' of the locks 16, 18 are the removable parts. Once the locking cylinders 76, 76' are removed, the handle 20 is free to pivot relative to the cap body 56 to permit the cap to be opened. It will be appreciated that even without the employment of the upper, first locking plate 12, the straight locks 16, 18 provide a high degree of security in view of the fact that the "Abloy" lock is virtually pick-proof. In the device manufactured by E. J. Brooks as above set forth, both the locking body 78 and the short locking cap 74 are hardened and are fabricated of a diameter that is too large to be cut through with all known type of available bolt cutters.

Figure 7:
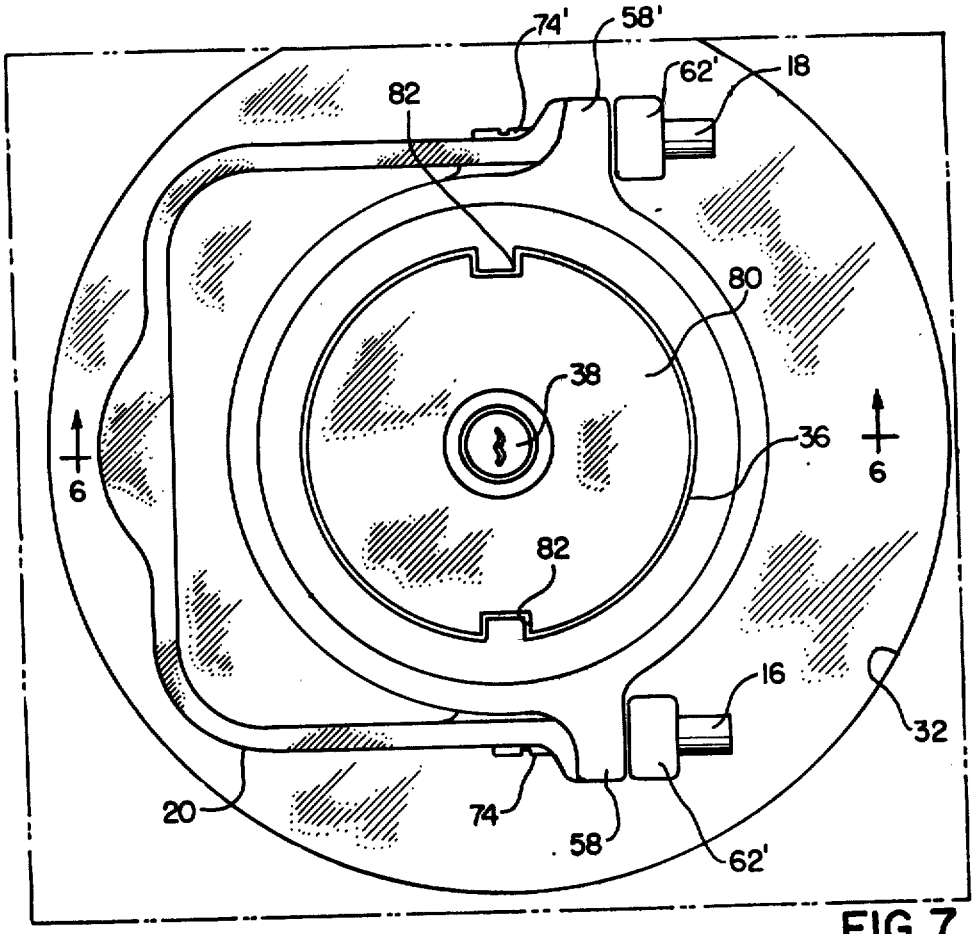
FIG. 7 is a cross sectional view looking from line 7—7 on FIG. 6.
Figure 6:
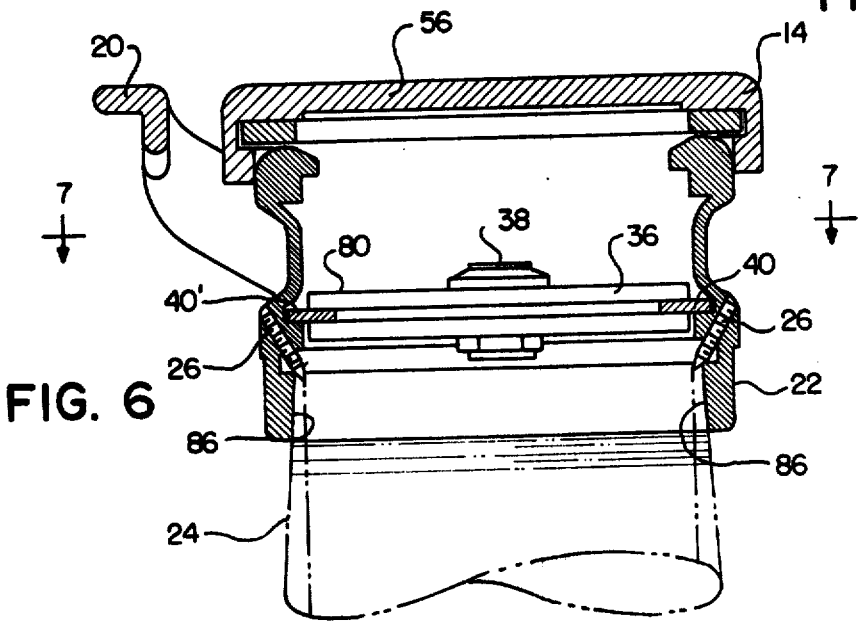
FIG. 6 is a cross sectional view showing the fill pipe lock assembly without the first cover plate.

As illustrated in FIGS. 2, 6 and 7, even after the tank fill cap 14 is removed, any would-be thief is still faced with a formidable access problem by virtue of the placement of the second locking plate 36. As illustrated, the second locking plate 36 includes a discoid body 80 which is centrally provided with a key cylinder 38 of any desired, known complexity. Preferably, the body 80 is hardened to thereby discourage any attempt to drill, hammer or otherwise impair the locking integrity of the second locking plate 36. Locking lugs 40, 40' are oppositely diametrically extended or retracted by the key cylinder 38 in known manner and are configured and positioned to alternately fit within and to be removed from association with the internal groove 34 which is machined or otherwise formed into the interior periphery of the adaptor 22. One or more peripheral cut outs may be provided if necessary to accommodate interior lugs (not shown) or other obstructions ordinarily formed in the adaptor 22 (for other purposes) to thus provide adequate clearance. In the embodiment of FIGS. 6 and 7, the upper, first locking plate has been omitted, but it will be noted that access to the fill pipe is still denied.

Figure 8:
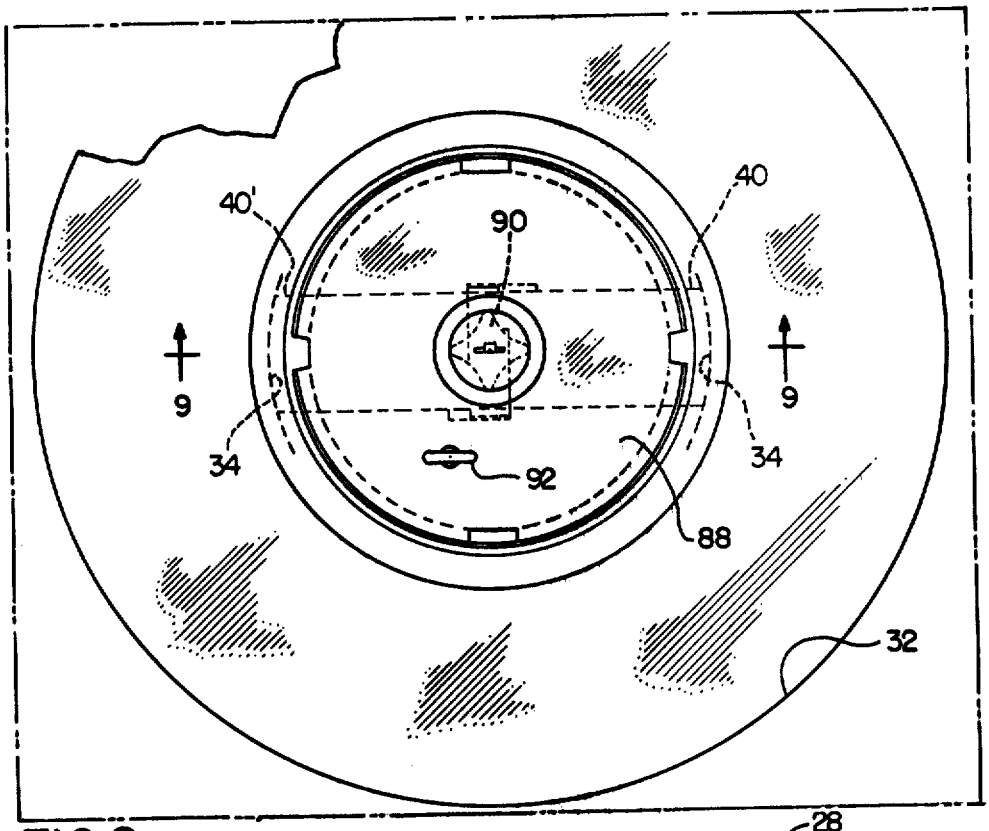
FIG. 8 is a top plan view showing a modified second locking plate in position in an adaptor.
Figure 9:
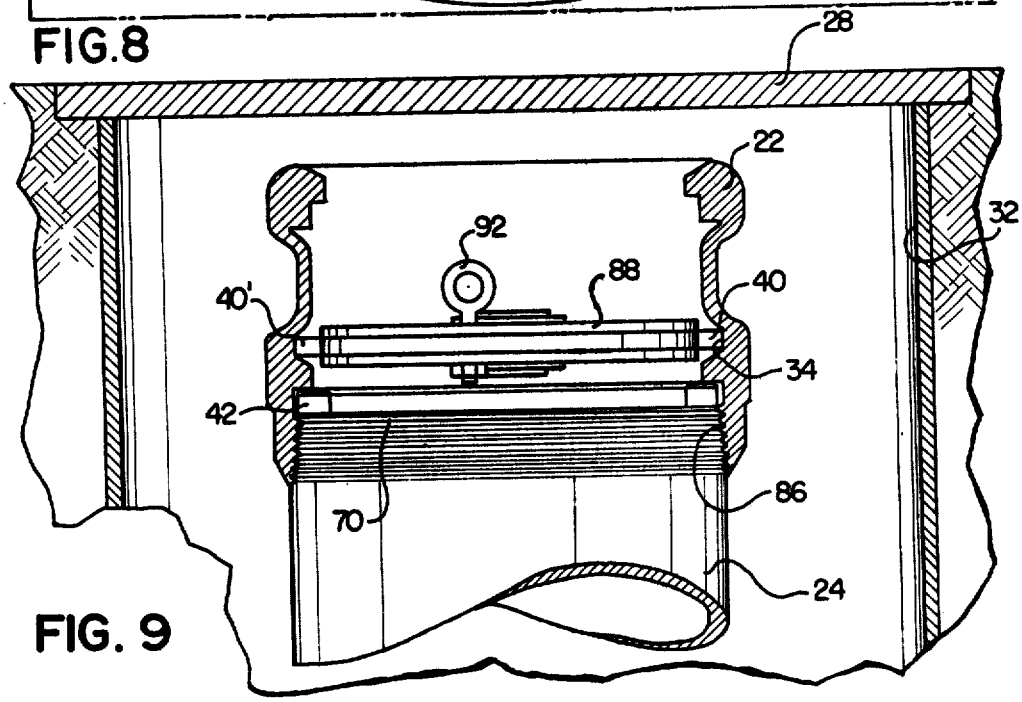
FIG. 9 is a cross sectional view taken along line 9—9 on FIG. 8 showing a locking arrangement without a first locking plate or a locked fill cap.

It will be appreciated that the tank fill cap locking system in accordance with the present invention may be utilized in its entirety or optionally, may find utility by employing one or more sub-components, depending upon actual field conditions. It is noteworthy that the protective features of the invention could be utilized either singley or collectively, as elected by the owner or operator of the underground storage tanks being protected. For example, either or both of the first locking plate 12 and/or the second locking plate 36 could be eliminated and the system could still provide effective protection through the use of the straight shackle, high security locks 16, 18 in combination with the tank fill cap 14. Alternately, the locks 16, 18 could be eliminated, the first hardened steel locking plate 12 could be eliminated and the interiorly positioned second locking plate 36 could still provide effective protection. See FIGS. 8 and 9. Also, the second locking plate 36 could be entirely eliminated and the tank fill opening could conceivably be adequately protected by employing the combination of the first hardened steel plate 12 in combination with the first and second straight shackle locks 16, 18. See FIGS. 4 and 5. Additionally, the outer or first locking plate could be eliminated to expose the fill cap 14 within the manhole 28. In such an instance, if so desired, conventional, sturdy padlocks (not shown) could be substitued for the straight shackle locks 16, 18.

While a flat top cap 14 has been illustrated by way of example in FIGS. 2, 3, and 4 for use with the first locking plate 12, it will be understood that other types of caps could be utilized when the first locking plate will not be used. For example, in the configuration of FIGS. 6 and 7, in place of the flat top type of fill cap 14 illustrated, other types of fill caps, such as a "step on" type, could be also employed. Also, a modified second lock plate 88 with key 92 and operator 90 could be substituted for the lock plate 36 of FIG. 3.

In order to use the fill cap locking system 10 of the present invention, an adaptor 22 with internal groove 34 should be threadedly engaged at the upper end 66 of the fill pipe 24, utilizing a suitable gasket 70. Preferably, the adaptor is secured against turning by a plurality of fasteners 26. A second lock plate 36 (or 88) is then engaged within the adaptor by employing a key (not shown) to turn the cylinder lock 38 as necessary to engage the locking lugs 40, 40' within the groove 34. The key is then removed and a cap 14 is applied over the adaptor 22. The handle 20 is operated as necessary to secure the cap and to align the pairs of locking holes 58, 64 and 58', 64'. The first cover plate 12 can then be applied over the fill cap by engaging the lip 84 of the handle bracket 52 under the cap handle 20, and by aligning the lock bracket openings 48, 48' respectively with the aligned pairs of openings 58, 64 and 58', 64'. Straight shackle locks 16, 18 can then be inserted through the aligned openings 58, 64, 54 or 58', 64', 54' respectively to provide a double locked and extremely secure construction.

Although the present invention has been described with reference to the particular embodiments herein set forth, it is understood that the present invention disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A tank fillcap locking systems for protecting the filling end of a tank fill pipe comprising an adaptor engaged upon the filling end of the fill pipe, the adaptor being provided with an internal groove;

a second locking plate means releasably connected to the adaptor at the said groove to obstruct the fill pipe;

a fill cap removably attached to the adaptor over the second locking plate means;

a first locking plate means overfitting the fill cap and at least partially covering the fill cap, the fill cap comprising a body and a handle movable with respect thereto between open and closed positions, the first locking plate means comprising a handle bracket adapted to engage a portion of the handle; and lock means between the fill cap and the first locking plate means to releasably secure the first locking plate means to the fill cap.

2. The system of claim 1 wherein the second locking plate means comprises a second lock and an extendable lug, the lug being extendable into the said internal groove and being adapted to be locked therein by the second lock.

3. The system of claim 1 and a safety means secured in the adaptor below the second locking plate means to prevent inadvertent passage of the second locking plate means through the adaptor.

4. The system of claim 1 and a means provided to secure the fill cap handle to the body to prevent removal of the cap from the adaptor.

5. The system of claim 4 wherein the means comprises a pair of openings respectively through portions of the body and the handle, the openings being aligned when the handle is moved to its said closed position.

6. The system of claim 5 wherein the said lock means is adapted to insert through the aligned openings to secure the first locking plate.

7. The system of claim 6 wherein the first lock plate means comprises a locking bracket having a hole, the hole being adapted to align with the said aligned openings whereby a single lock can secure the fill cap body, the fill cap handle and the first locking plate means.

8. The system of claim 7 wherein the lock means comprises a straight shackle lock.

9. The system of claim 1 wherein the adaptor threadedly engages the fill pipe and fastener means to prevent unthreading of the adaptor from the fill pipe.

10. A fill cap locking system for protecting the upper end of a tank fill pipe comprising an upper first locking plate, the first locking plate being provided with bracket means to secure the first locking plate;

a fill cap positioned over the fill pipe and below the first locking plate, the fill cap comprising a body and a handle, the handle being movable relative to the body between open and closed positions, the body and the handle being provided with cooperating openings;

a locking means removably securing the first locking plate to the fill cap to prevent unauthorized removal of the fill cap, the locking means being removably positioned through the cooperating openings to lock the fill cap on the fill pipe when the handle is in its said closed position, an adaptor engaged upon the fill pipe in position to receive the fill cap, the fill cap being adapted to be releasably secured to the adaptor; and the first locking plate comprising a lock bracket having an opening, the bracket opening being adapted to align with the said fill cap and handle cooperating openings, when the handle is in its said closed position whereby the said locking means can also lock the first locking plate to the fill cap;

whereby access to the fill pipe can be prevented until such time as the first locking plate is removed from above the fill cap.

11. The system of claim 10 wherein the locking means comprises a straight shackle lock.

12. The system of claim 10 wherein the adaptor comprises an attaching means and a second locking plate removable secured to the adaptor at the attaching means to obstruct the fill pipe.

13. The system of claim 12 wherein the second locking plate comprises a body, a second lock and at least one locking lug, the locking lug being movable into and out of the attaching means upon operation of the second lock.

14. The system of claim 12 wherein the attaching means comprises a circular groove interiorly formed in the adaptor.

* * * * *